US005915531A

United States Patent [19]

Hilpert et al.

[11] Patent Number: 5,915,531

[45] Date of Patent: Jun. 29, 1999

[54] MATERNITY EXERCISE GARMENT/ UNDERGARMENT

[76] Inventors: Bess P. Hilpert, 2051 Crabapple Cove, Round Rock, Tex. 78681; Virginia Joan Harrison, 10111 Treasure Island Dr., Austin, Tex. 78730

[21] Appl. No.: 08/975,998

[22] Filed: Nov. 21, 1997

[51] Int. Cl.[6] ..... A41D 1/20; A41C 1/08

[52] U.S. Cl. ..... 2/69; 2/78.3; 2/109; 450/8; 450/155

[58] Field of Search ..... 2/69, 76, 78.3, 2/109, 67, 406, 221, 237, 238; 450/7, 8, 11, 155, 101, 22, 18, 100, 104, 122, 123

[56] References Cited

U.S. PATENT DOCUMENTS

| | | | |
|---|---|---|---|
| 171,012 | 12/1875 | Griswold . | |
| 741,521 | 10/1903 | Martin . | |
| 912,769 | 2/1909 | Anderson . | |
| 2,290,485 | 7/1942 | Sutter | 2/27 |
| 2,875,763 | 3/1959 | Marchisella | 450/8 |
| 3,101,718 | 8/1963 | Rocker | 128/520 |
| 3,357,435 | 12/1967 | Enrico | 128/431 |
| 4,494,546 | 1/1985 | Steiman | 128/431 |
| 4,746,318 | 5/1988 | Moyer | 450/155 |
| 4,789,372 | 12/1988 | Wicks | 450/155 |
| 4,952,192 | 8/1990 | Burke | 450/15 |
| 4,976,653 | 12/1990 | White | 450/155 |
| 5,094,648 | 3/1992 | Turner | 450/155 |
| 5,189,736 | 3/1993 | Price | 2/69 |
| 5,217,403 | 6/1993 | Nobbs | 2/406 |
| 5,702,286 | 12/1997 | Seering et al. | 450/155 |

OTHER PUBLICATIONS

Advertisement "Jeunique Natal Support and Jeunique Back-–To–Normal"; Date Unknown.

Advertisement "New Playtex Expectant Moments Lingerie for Real Life"; Date Unknown.

Advertisement "Wholesale Maternity Exercise Wear by Wolf Wear Fitness Apparel"; Date Unknown.

FIT PREGANCY; Advertisement "Jeunique Natal Support" Winter 1996.

*Primary Examiner*—Amy B. Vanatta
*Attorney, Agent, or Firm*—Arnold, White & Durkee

[57] ABSTRACT

A pregnant woman's exercise garment has an integrated support structure for supporting the athletic mother-to-be safely and comfortably and for alleviating the discomfort associated with the physiological changes encountered during pregnancy. The garment includes uterine support panels that cradle the abdominal wall for alleviating downward pressure. The garment also has lower back support panels to protect the sacral and lower lumbar vertebrae of the spine, and inner thigh panels designed to ease the sometimes debilitating sciatica and groin pain. These pieces can be inserted separately or in combination in other athletic wear (i.e. running shorts, swim wear, tennis apparel, etc.) designed specifically for the athletic expectant mother. The garment may also be worn as an undergarment lending support to women whose work requires movement and/or standing for extended periods of time.

21 Claims, 7 Drawing Sheets

MATERNITY EXERCISE GARMENT/ UNDERGARMENT

FIELD OF THE INVENTION

The present invention relates to clothing in general, and more specifically to a maternity exercise garment.

BACKGROUND OF THE INVENTION

Pregnancy is a highly complex physiological state. A woman's entire physiological system is readjusted when pregnant. The heart pumps more blood. The lungs work more efficiently, and the digestive system uses all the food it receives more effectively. The thyroid gland grows fifty percent bigger during pregnancy to meet the demands of increased metabolism. The woman's breasts swell as the milk glands develop. Moreover, because of the enlarging womb, the pregnant woman's lower back develops more curvature, and her body's center of gravity shifts. This postural shift can lead to lumbar lordosis, which is an abnormal forward curvature of the spine. The enlarged uterus also presses on major blood vessels and nerves. Furthermore, a pregnant woman's core body temperature rises. Women who are extremely fit, however, actually have improved body temperature regulation and thus have lower core body temperatures during pregnancy. Also, in pregnancy, the vagina offers a chemically hospitable environment for certain infections, in particular, a yeast-like fungus called Candida Albicans.

Hormonal changes also cause a variety of physiologic opportunities. Two circulating hormones, prolactin and relaxin, loosen and soften ligaments and joints of the body. The blood vessels become relaxed, so blood pools in the legs. There is often a softening of the joint between the pubic bones and sometimes even a separation of these bones. Two sets of ligaments moors the uterus. The round ligaments insert into the groin on the left and right in front of the birth canal. The uterosacral ligaments attach just below the small of the back to each side of the bony structures of the pelvis. Stretching of these ligaments which support the uterus can cause groin pain. Additionally, the hormone progesterone relaxes the ligaments in the back. But unlike muscles which return to their prior shape after being stretched, ligaments remain stretched out.

Due to these anatomical and hormonal changes, exercise within the American College of Obstetricians and Gynecologists (ACOG) guidelines can improve the overall physical and psychological health of the expectant woman, as confirmed by current scientific research. Studies done by J. L. Clapp, III, of Case Western Reserve Medical School showed that aerobically fit women who continued to exercise during pregnancy had a greater stroke volume and VO2 responses at a given heart rate as compared to their sedentary counterparts. Maureen Hatch of Columbia University showed that women who exercise during pregnancy have larger babies who tend to be healthier. Exercise before and during pregnancy apparently plays an important role in promoting the health and well-being of the expectant mother. It will help improve blood circulation, will allow for more efficient digestion, and will provide relief of hemorrhoids and constipation often associated with the later stages of pregnancy. Exercise also improves the consumption and uptake of oxygen. Moreover, exercise has been attributed to aiding labor and delivery as well as shortening postpartum recovery time. In general exercise aids the pregnant woman in feeling better about her changing physique, both physiologically and psychologically. And although pregnancy is not a time to "over-do it", it does not mean that overall physical fitness inevitably declines if the pregnant athlete continues to exercise.

Because of all the physiological changes mentioned above, a pregnant woman needs supporting garments more so than when she is not pregnant. Prior art attempts to address a pregnant woman's changing physiology to help pregnant women exercise with greater comfort have been generally deficient. Moyer's maternity exercise garment, disclosed in U.S. Pat. No. 4,746,318, has a support belt attached to the breast support band, and an abdominal support band attached at the pubis. It is believed that as the expectant mother's belly grows, the breast support of Moyer would appear to pull down off the chest, and the crotch area may feel a cutting sensation as the fabric pulls forward. Moreover, it appears that Moyer's encircling abdominal band would likely press down on the stomach instead of providing the desired relief. Similarly, the torso support garment disclosed by Turner in U.S. Pat. No. 5,094,648 would appear to have the problem of the bra being pulled off the chest as the woman's belly grows. Turner's elastic belt may also ride up onto the stomach during vigorous movement. It is also believed that the maternity garment disclosed by White in U.S. Pat. No. 4,976,653 would inadequately support the back and abdomen when a woman is engaged in weight-bearing exercise. The prior art garments appear to have been binding, uncomfortable, restrictive, and generally inadequate in supporting the weight of the belly during aerobic activity or weight-bearing exercises.

The benefits of exercise during pregnancy are well documented. Unfortunately, currently available maternity athletic wear apparently provide insufficient comfort for the exercise-conscious expectant mothers. In particular, there is a lack of maternity exercise garments that would provide sufficient support for expectant exercisers throughout the full pregnancy term, and especially for joggers who want to continue jogging during the later months of pregnancy.

SUMMARY OF THE INVENTION

The invention provides a fashionable but functional exercise garment for the pregnant woman. This maternity exercise garment is comfortable and provides increased support through an integrated support structure, thus allowing for exercise during the full pregnancy term. The support structure has an abdominal sling to help bear the weight of the uterine wall, thus decreasing the downward pressure experienced during weight-bearing exercise. The support structure also has a polygon-shape, typically pentagonally, back support panel at the base of the spine, which helps to preserve the natural curvature of the spine and thus tends to reduce back pain. The support structure may additionally have inner thigh panels to help alleviate the pain often associated with nerve pressure due to the relaxation of the round ligaments supporting the pelvic girdle. The exercise garment also may include a crotch panel which can be treated with a medicating agent to help protect the vaginal area from potential infection.

These and other features, and advantages, will be more clearly understood from the following detailed description taken in conjunction with the accompanying drawings. It is important to point out that the illustrations may not necessarily be drawn to scale, and that there may be other embodiments of the present invention which are not specifically illustrated. Furthermore, as many of the figures illustrate the same or substantially similar elements, like reference numerals will be used to designate elements that are the same or substantially similar in either shape or function.

DETAILED DESCRIPTION OF A PREFERRED EMBODIMENT

This invention seeks to counteract key areas of discomfort for the pregnant athlete as her physiology changes during the various phases of pregnancy. Special support panels are used to provide a garment that would assist the athletic mother-to-be to continue her physical regimen while decreasing the distractions normally associated with the changing physique of pregnancy. Specifically, this garment addresses discomfort in the abdomen and back from the increased weight of the developing fetus, discomfort in the inner thighs from the loosening of the pelvic ligaments, and infections due to the increased hormone levels in the vaginal area. The garment may also be worn as an undergarment to provide all-day support.

Figure 1:
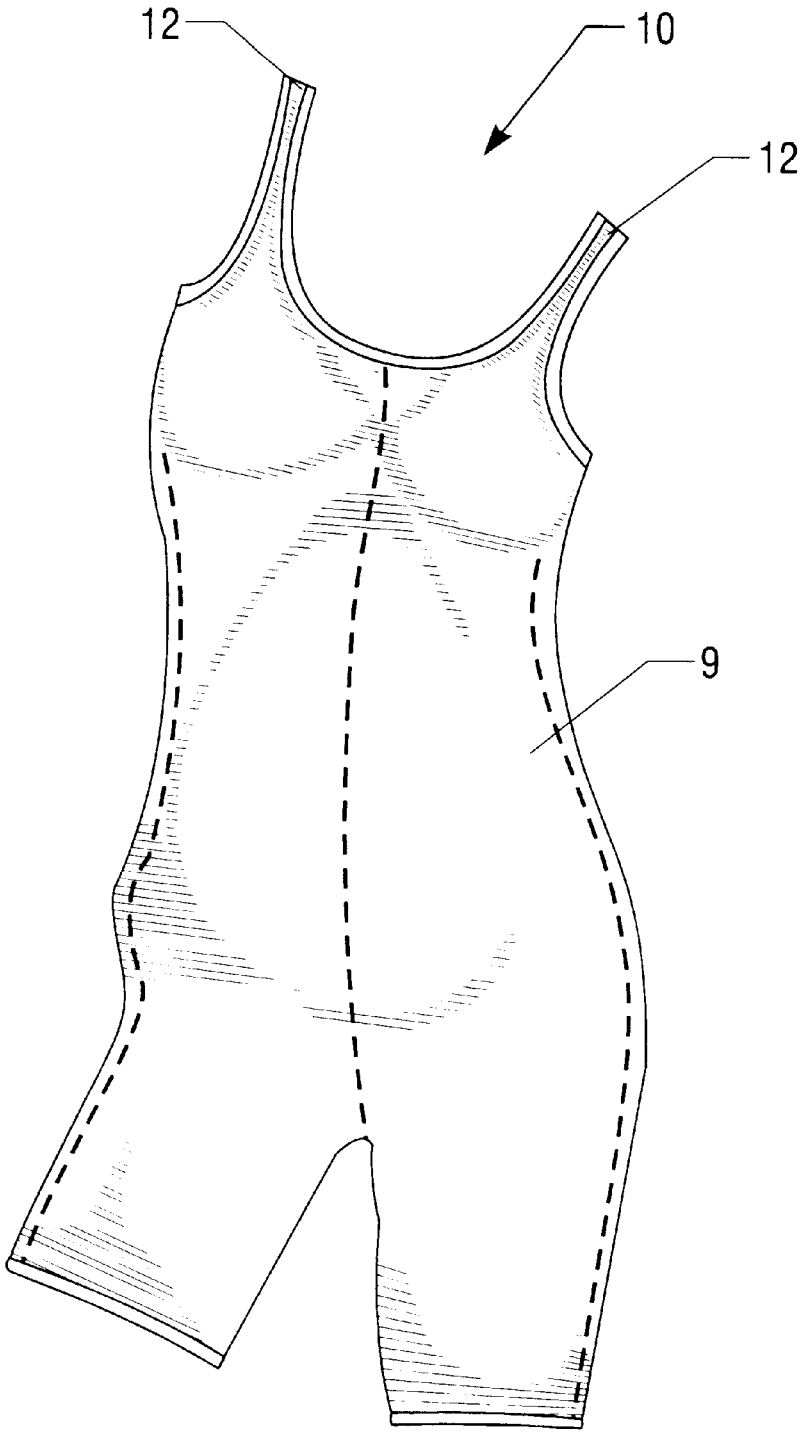
FIG. 1 illustrates, in a front view, a maternity exercise garment's outer shell, in accordance with an embodiment of the present invention.
Figure 2:
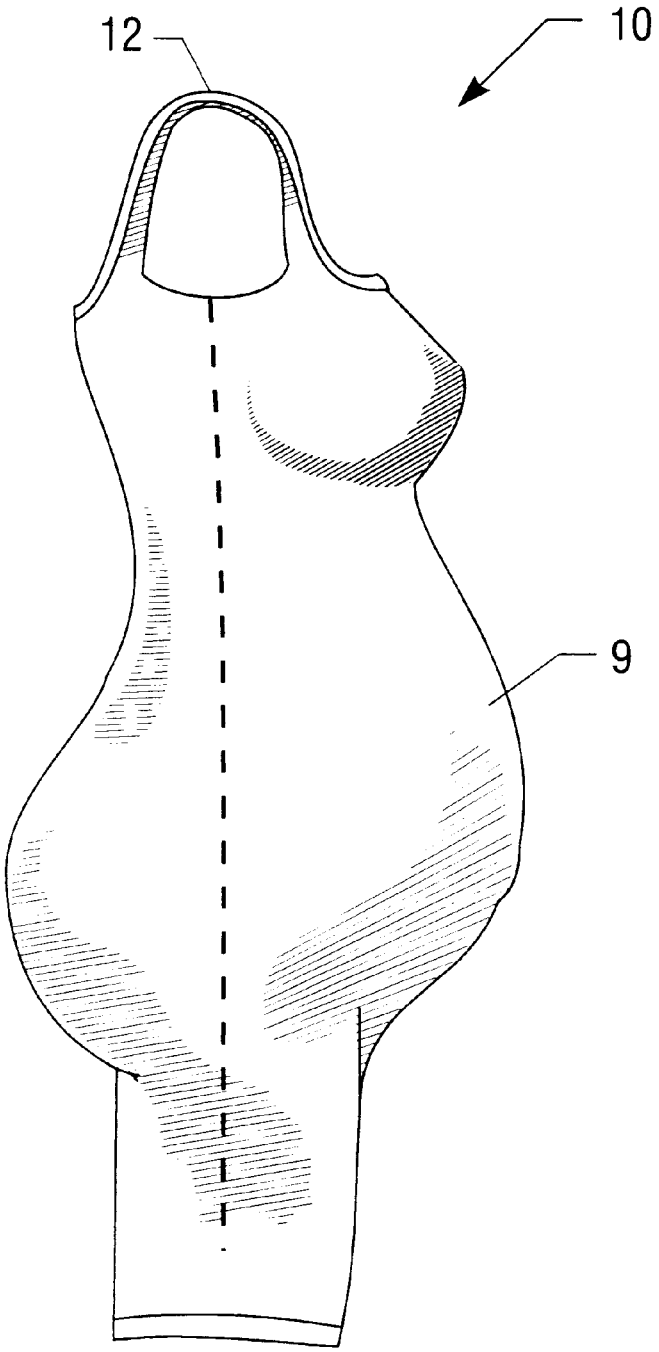
FIG. 2 illustrates, in a side view, the maternity exercise garment's outer shell of FIG. 1.
Figure 3:
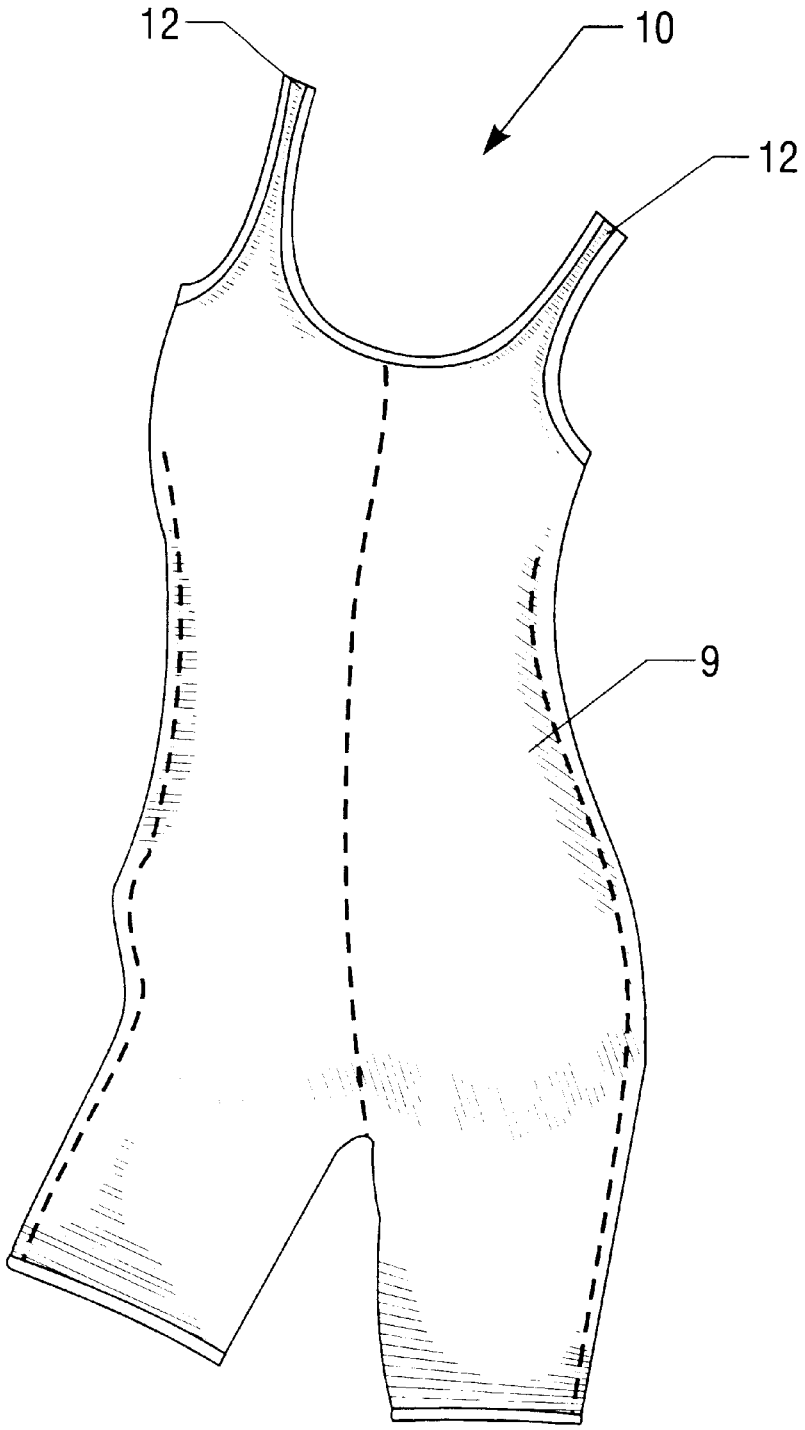
FIG. 3 illustrates, in a dorsal view, the maternity exercise garment's outer shell of FIG. 1.

FIGS. 1–3 illustrate the frontal, lateral and dorsal views of the outer shell 9 of the maternity garment 10 in accordance with the present invention. It is preferable that the garment 10 be constructed of a stretchy fabric that is supple and soft to provide freedom of movement as well as support. The fabric may also be porous and wickable, allowing for the material to "breathe" and for sweat to be moved quickly away from the body. Additionally, the fabric may be non-insulating to help the body quickly cool itself. Lastly, the fabric is preferably strong, light weight, and durable. A net-like fabric composed of stretchable synthetic spandex fibers would appear to be one such suitable fabric for use in the present invention.

The latest generation of state-of-the-art 4-way stretch fabrics, such as for example and without limitation, Bayer Corporation's Dorlastan®, may be used in making the maternity exercise garment of the present invention. Such a fabric is suitable to provide the support and freedom of motion afforded by the garment's design and has many of the desirable characteristics mentioned above.

An embodiment of the maternity garment 10 is illustrated in FIGS. 1–3 to be a unitard that would extend from the shoulders down to the mid-thigh when worn. It can be appreciated by one skilled in the art that the present invention could be embodied in a garment other than the unitard shown, such as a garment with sleeves, longer legs or made in component parts. The shoulder straps 12 may be adjustable by means of loops and buckle means or can be made with an elastic material, such as for example Ultimate Comfort®. This material mates well with a 4-way stretch fabric of the body of the garment and can provide support that is soft but not binding. This material may also be used for all elastic edges and straps on the garment.

Figure 4:
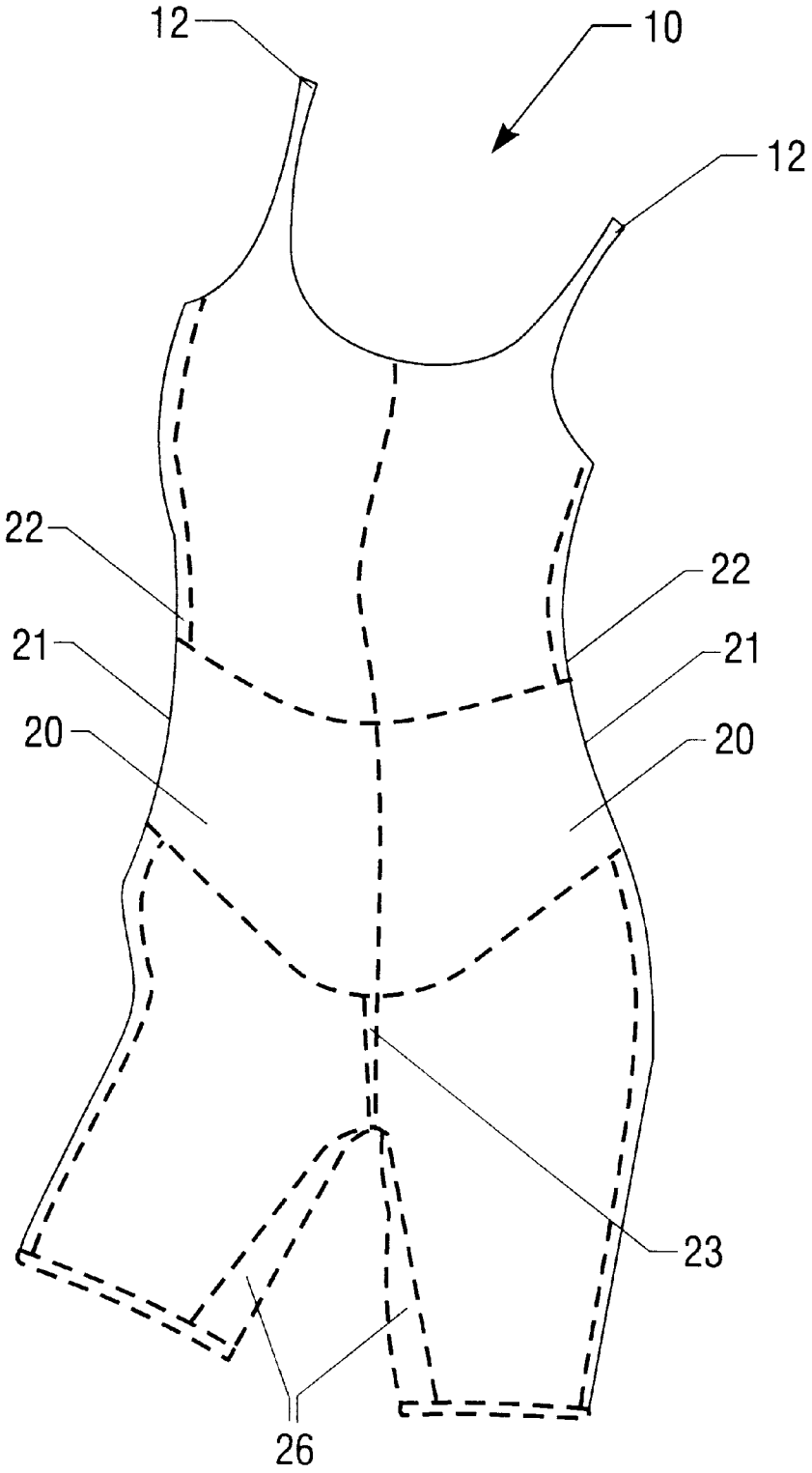
FIG. 4 illustrates, in front view, the maternity exercise garment's inner support structure showing an abdominal sling and inner thigh panels, in accordance with an embodiment of the present invention.
Figure 5:
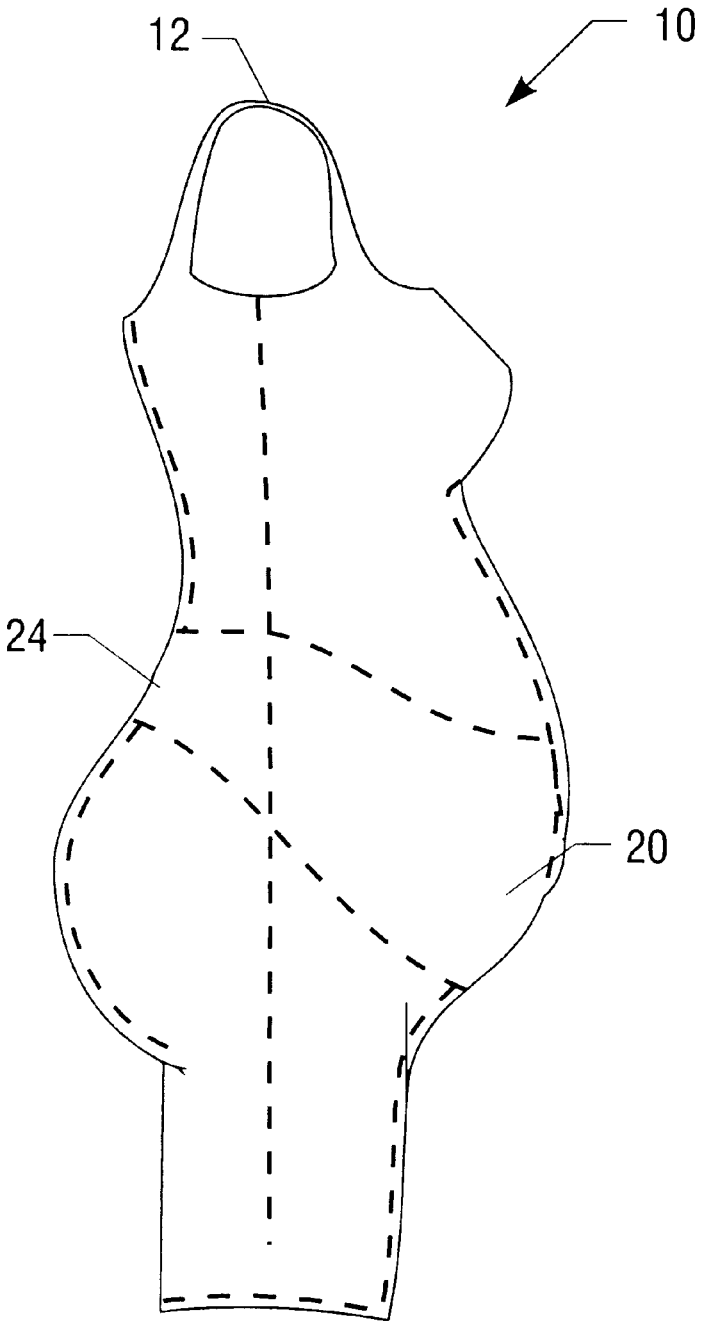
FIG. 5 illustrates, in side view, the maternity exercise garment's inner support structure showing the abdominal sling and a lower back support, in accordance with an embodiment of the present invention.
Figure 6:
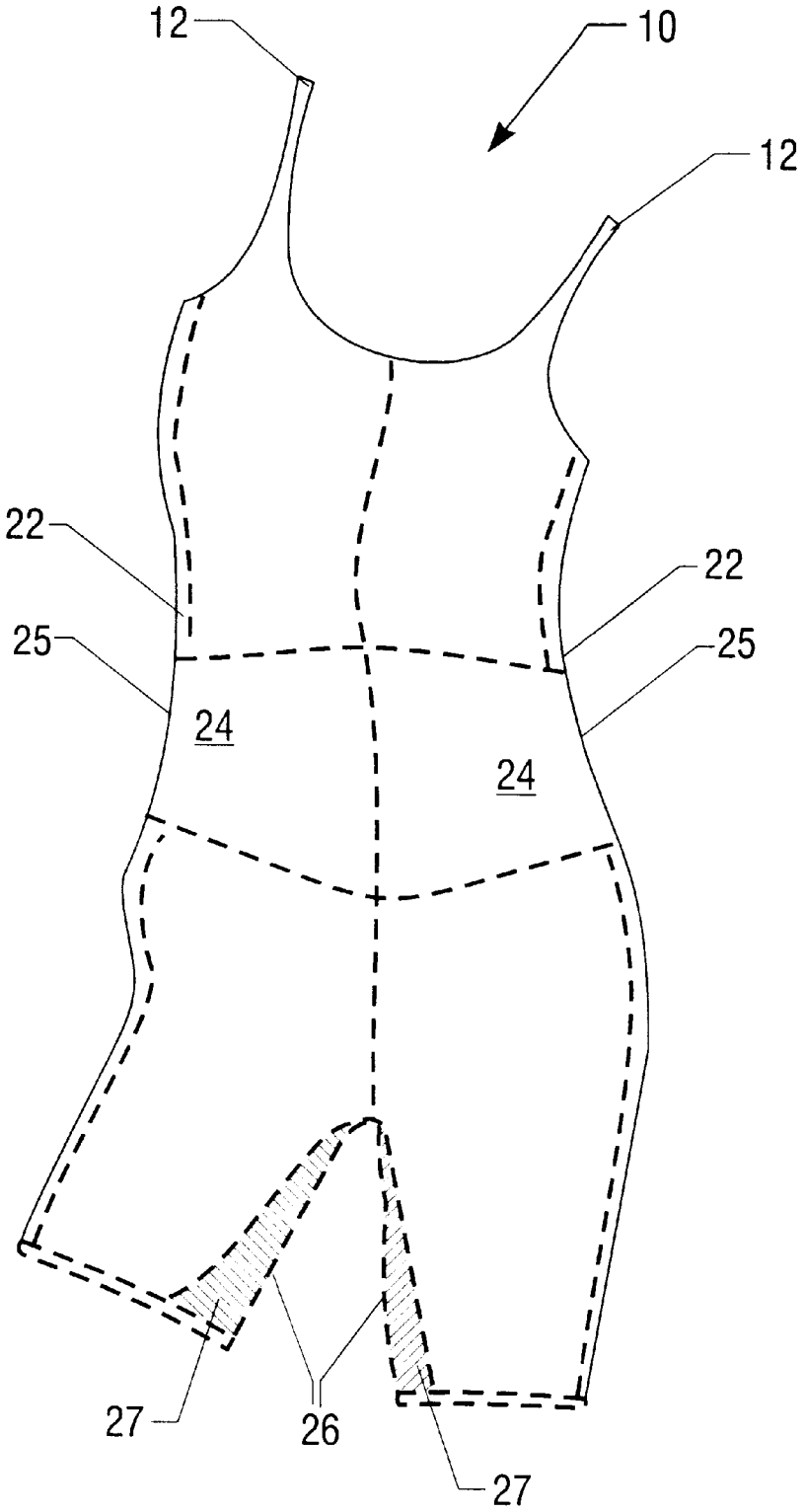
FIG. 6 illustrates, in dorsal view, the maternity exercise garment's inner support structure showing the lower back support and inner thigh panels, in accordance with an embodiment of the present invention.

FIGS. 4–6 illustrate frontal, lateral, and dorsal views of an embodiment of the integrated inner support structure system of the maternity garment 10 of the present invention. As can be seen in FIGS. 4 and 5, the support structure has an abdominal support sling or halter 20, for helping support the increased abdominal weight while allowing for increased mobility both longitudinally and laterally. This sling 20 is shaped to cradle, lift, and hold the expanding belly of the wearer and to hug the pelvic girdle area during movement without unduly compressing the abdominal wall. The ends 21 of abdominal sling 20 are each attached to the side seams 22 of the garment. An elastic strip 23 connects the base of the abdominal sling to the crotch area of the garment. This elastic strip 23 helps prevent the support sling 20 from changing position as the wearer's belly grows. When worn, the abdominal sling 20 typically runs from just above the pubis area of the wearer to just below the navel area. The abdominal sling 20 tends to cradle the uterus to help alleviate the downward pressure experienced during pregnancy, particularly during weight-bearing exercise.

The support structure of the maternity garment 10 may also contain a back support panel 24, illustrated in FIGS. 5 and 6, to support the sacrum and lower lumbar vertebrae. Each end 25 of back support 24 is sewn into the side seams 22 of the garment and is polygonally shaped to provide maximum support to selected areas of the lower back. One embodiment of back support 24 may be substantially pentagonal in shape, in consideration of the shape, position and curvature of the sacral and lumbar vertebrae. Back support 24 may cover at least a portion of the sacral area, and the upper apex of the pentagon-shape support panel may extend to the fifth lumbar vertebra. It is believed that the back support 24 tends to prevent lordosis, which is an abnormal curvature of the spine, by helping to balance the shifting center of gravity in the pregnant wearer. Back support 24 may also wrap securely around the area of the pelvic ligaments helping to counter the possibility of overstretching these ligaments as they are relaxed by the hormones relaxin and prolactin. Back support 24 does not, however, tend to restrict movement, but rather allow the natural curvature of the spine to remain. Back support 24 also does not tend to force the spine into an unnatural and rigid position.

The support structure of the maternity garment further includes inner thigh panels 26 (illustrated in FIGS. 4, 6 and 7) that lend support to the groin area to help alleviate the pain often associated with nerve pressure resulting from the relaxation of the round ligaments supporting the pelvic girdle area. Frequently, the pressure of the growing belly will press down on organs and the general pelvic structure, increasing pressure on the principle cutaneous nerves of the anterior thigh, and creating extreme discomfort. Inner thigh panel 26 may extend along substantially the entire length of the inner thigh/groin area of the garment 10 and may be attached in the crotch area of the garment and at the base of the leg seams 27. If the garment has center front or back seams, then the inner thigh panel 26 may be attached at the base of such center front and back seams.

Figure 7:
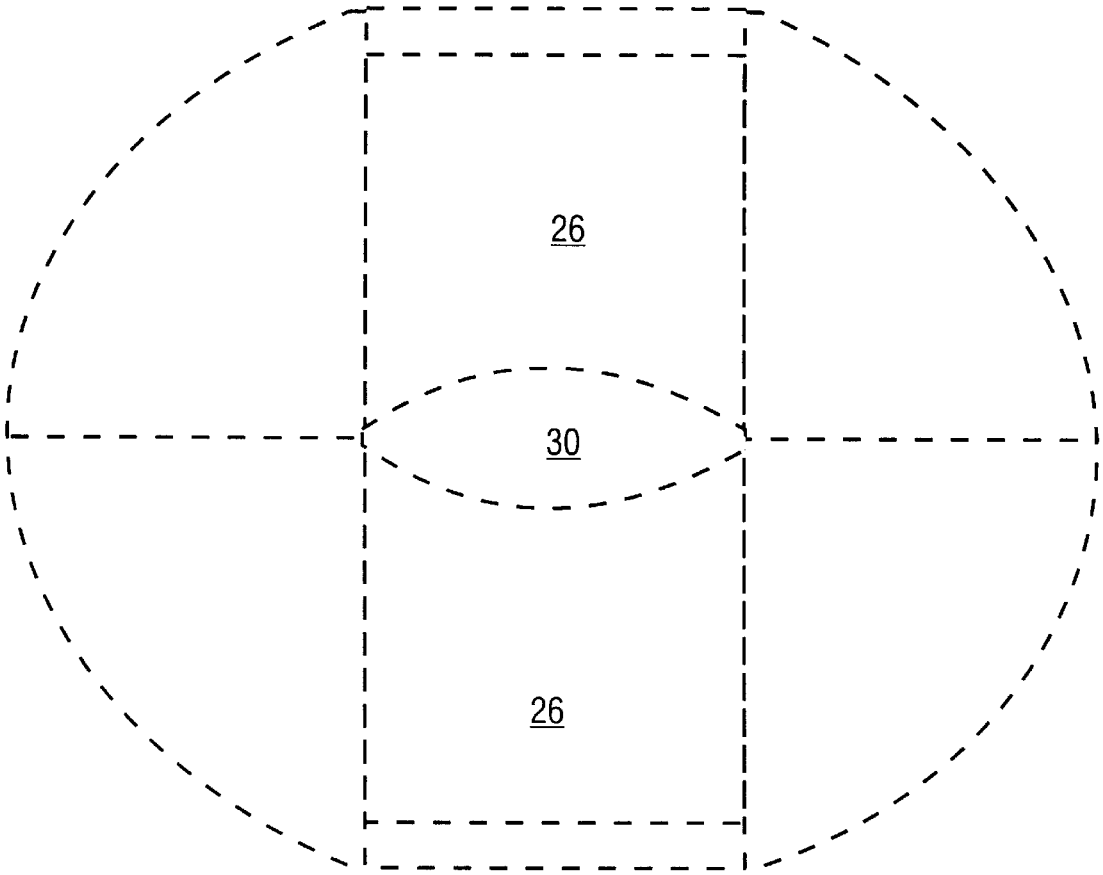
FIG. 7 illustrate, in a top view, the maternity exercise garment's inner support structure showing a crotch panel and the inner thigh panels, in accordance with an embodiment of the present invention.

As illustrate in FIG. 7, the maternity garment 10 of the present invention may also include a crotch panel 30, that may include a medication such as an acceptable non-toxic anti-infection agent. The medicating agent may be either antibacterial and/or antifungal to protect the vaginal area from various kinds of bacterial and fungal infections often experienced by women during pregnancy due to the chemical changes in the body. The crotch area of the maternity garment 10 may optionally have releasable fastening devices such as snaps or hook and eye clasps instead of a closed seam. This option may be desirable for women who wish to wear the garment as an undergarment under other clothing or for other extended wear uses.

The foregoing description and illustrations contained herein demonstrate many of the advantages associated with the present invention. In particular, it has been revealed that prior art maternity garments are believed to be uncomfortable and have not provided the needed support for pregnant women who wish to engage in an exercise regimen. The present invention offers significant improvements over the prior art in that it provides a support structure system which provides an abdominal sling or halter for supporting the uterus area, a polygon-shaped back support to support the spine area in its natural curvature, and thigh panels to support the groin area. The garment may be made of a soft and supple fabric that is preferably porous so that the body does not overheat. An added benefit of the present invention is that the crotch panel may be treated with a non-toxic antibacterial and/or antifungal agent to protect the woman from potential vaginal infections.

Thus, it is apparent that there has been provided, in accordance with the invention, a maternity garment that substantially meets the needs and advantages set forth previously. Although the invention has been described and illustrated with reference to specific embodiments thereof, it is not intended that the invention be limited to these illustrative embodiments. Those skilled in the art will recognize that modifications and variations can be made without departing from the spirit of the invention. For example, the support structure may be integrated on the outside of the garment. Different colors and patterns may be used for the different components of the support structure to lend a colorful and attractive design to the garment. The garment may also be worn as an undergarment lending support to women whose work requires movement and/or standing for extended periods of time. Alternatively, the garment may be worn by anyone who could benefit from the localized support provided by the garment's inner support structure. It is important to recognize that the individual elements of the inner support structure can be combined in a different sequence within other maternity fitness wear, such as running shorts, leotard pants, bike shorts, tennis skirt, swim suit or leotard (which may all contain the present invention described above). It is also important to note that practice of the present invention is not limited to the materials disclosed, as other materials having the desired characteristics may be used. Therefore, it is intended that this invention encompass all such variations and modifications falling within the scope of the appended claims.

What is claimed is:

1. A garment to be worn by a pregnant woman, comprising:

an outer shell for covering a portion of the woman's body, the outer shell having a crotch area;

a support structure attached to the outer shell for providing support to selected areas of the woman's body during movement, said support structure including:

an abdominal sling attached to the outer shell so as to support the lower abdominal area of the woman;

a lower back support panel having each end attached to the outer shell and extending across the lower back area of the woman to provide support to the sacral and the lower lumbar area; and an inner thigh panel attached to the crotch area of the outer shell, said thigh panel extending downwardly from the crotch area of the shell to support a portion of the inner thigh area of the woman; and a crotch panel attached to the outer shell adjacent the crotch area of the shell.

2. The garment of claim 1, wherein at least one of the abdominal sling, the lower back support panel and the inner thigh panel is made of a 4-way stretch fabric.

3. The garment of claim 1, wherein the lower back support panel is polygon-shaped.

4. The garment of claim 3, wherein the polygon-shape lower back support panel is substantially pentagonal and is sufficiently wide to cover at least a portion of the sacral and the lower lumbar vertebrae.

5. The garment of claim 1, wherein the abdominal sling substantially extends from just above the pubis area of the woman to just below the navel area of the woman, thereby supporting the uterine area of the woman.

6. The garment of claim 1, wherein the outer shell is made of a porous and wickable material to allow for sweat to be moved quickly away from the woman's body.

7. The garment of claim 1, wherein the outer shell is made of a non-insulating material to allow the woman's body to cool itself.

8. The garment of claim 1, wherein at least one of the outer shell, the abdominal sling, the lower back support panel, and the inner thigh panel is made of a net-like fabric composed of a stretchable synthetic spandex fiber.

9. The garment of claim 1, wherein the outer shell is a unitard.

10. The garment of claim 1, wherein the crotch panel has a medicating agent for preventing infections.

11. The garment of claim 10, wherein the medicating agent is either an antibacterial agent or an antifungal agent.

12. A maternity garment to be worn by a pregnant woman, comprising:

an outer shell for covering a portion of the woman's body, the outer shell having a crotch area and extending from the shoulder area to the mid-thigh area of the woman's body;

a support structure made of a 4-way stretch material and attached to the outer shell for providing support to selected areas of the woman's body during movement, said support structure comprising:

an abdominal sling attached to the outer shell so as to support the lower abdominal area from just above the pubis area to just below the navel area, thereby providing support to the uterine area;

a polygon-shape lower back support panel having each end attached to the outer shell and extending across the lower back area of the woman, the polygon-shaped back support panel being sufficiently wide to cover at least a portion of the sacral and the lower lumbar vertebrae to support the sacral and the lower lumbar area of the woman; and an inner thigh panel attached to the crotch area of the outer shell, said thigh panel extending downwardly from the crotch area to provide support to at least a portion of the inner thigh of the woman; and a crotch panel for retaining a medicating agent for preventing infections, said crotch panel being attached to the outer shell adjacent the crotch area of the shell.

13. The garment of claim 12, wherein the outer shell has an adjustable shoulder strap.

14. The garment of claim 12, wherein the outer shell is made of a net-like fabric that stretches in multiple directions, said net-like fabric being wickable to allow for sweat to be moved quickly away from the woman's body.

15. The garment of claim 12, wherein a bottom portion of the abdominal sling is attached to the crotch area of the outer shell with an elastic strip.

16. The garment of claim 12, wherein the medicating agent for the crotch panel is either an antibacterial agent or an antifungal agent.

17. An support garment to be worn by a wearer, comprising:

an outer shell for covering a portion of the wearer's body, said outer shell having a crotch area; and a support structure attached to the outer shell for providing support to selected areas of the wearer's body during movement, said support structure comprising:

an abdominal halter attached to the outer shell for supporting the wearer's lower abdominal area from just above the pubis area to just below the navel area;

a substantially pentagon-shaped lower back support panel having each end attached to the outer shell and extending across the lower back of the wearer, the pentagon-shaped back support panel being sufficiently wide to cover and provide support to at least a portion of the sacral and the lower lumbar area;

an inner thigh panel attached to the crotch area of the outer shell, said thigh panel extending downwardly from the crotch area to support a portion of the inner thigh of the wearer; and a crotch panel attached to the outer shell adjacent the crotch area of the shell.

18. The garment of claim 17, wherein at least one of the outer shell, the abdominal halter, the lower back support panel and the inner thigh panel is made a 4-way stretch material.

19. The garment of claim 17, wherein at least one of the outer shell, the abdominal halter, the lower back support panel and the inner thigh panel is made of a net-like fabric composed of a stretchable synthetic spandex fiber.

20. The garment of claim 17, wherein the outer shell is made of a porous and wickable material to allow for sweat to be moved quickly away from the wearer's body.

21. The garment of claim 17, wherein the outer shell is made of a non-insulating material to allow the wearer's body to cool itself.

* * * * *